US010322910B2

(12) United States Patent
Dharmaraj

(10) Patent No.: US 10,322,910 B2
(45) Date of Patent: Jun. 18, 2019

(54) ELEVATOR DOOR COUPLER ASSEMBLY

(71) Applicant: Otis Elevator Company, Farmington, CT (US)

(72) Inventor: Suresh Dharmaraj, Florence, SC (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 220 days.

(21) Appl. No.: 15/398,539

(22) Filed: Jan. 4, 2017

(65) Prior Publication Data

US 2017/0190547 A1 Jul. 6, 2017

Related U.S. Application Data

(60) Provisional application No. 62/274,573, filed on Jan. 4, 2016.

(51) Int. Cl.
*B66B 13/12* (2006.01)
*B66B 13/30* (2006.01)

(52) U.S. Cl.
CPC ..... *B66B 13/12* (2013.01); *B66B 13/30* (2013.01)

(58) Field of Classification Search
CPC ..... B66B 13/12; B66B 13/30
See application file for complete search history.

(56) References Cited

U.S. PATENT DOCUMENTS 4,357,998 A * 11/1982 Gibson ..... B66B 13/12 187/314
4,947,964 A * 8/1990 Husmann ..... B66B 13/12 187/314
5,005,673 A * 4/1991 Rivera ..... B66B 13/12 187/319
5,139,112 A * 8/1992 Tonna ..... B66B 13/12 187/331
5,246,089 A * 9/1993 Husmann ..... B66B 13/12 187/319
5,538,106 A * 7/1996 McHugh ..... B66B 13/12 187/330
5,575,357 A * 11/1996 Spiess ..... B66B 13/12 187/319
5,651,427 A * 7/1997 Kulak ..... B66B 13/12 187/330
5,651,428 A * 7/1997 Ahigian ..... B66B 13/12 187/330

(Continued)

FOREIGN PATENT DOCUMENTS

CA 2146106 A1 10/1995
CN 102190234 A 9/2011
JP H06227780 A 8/1994

OTHER PUBLICATIONS

European Search Report for application EP 16206724.3, dated May 31, 2017, 8 pages.

*Primary Examiner* — Michael A Riegelman
(74) *Attorney, Agent, or Firm* — Cantor Colburn LLP

(57) ABSTRACT

A door coupling assembly for an elevator system. The coupling assembly includes a first vane, including a first surface extending longitudinally vertically to the elevator car door and a second vane, including a second surface and a third surface extending longitudinally vertically in parallel with the first vane; wherein the second surface is laterally spaced to the first surface by a first vane length, and the third surface is laterally spaced to the first surface by a second vane length.

9 Claims, 5 Drawing Sheets

(56) References Cited

U.S. PATENT DOCUMENTS

| | | | | |
|---|---|---|---|---|
| 5,732,796 | A * | 3/1998 | Ahigian | B66B 13/12 187/314 |
| 6,446,759 | B1 * | 9/2002 | Kulak | B66B 13/12 187/319 |
| 9,663,329 | B2 * | 5/2017 | Zappa | B66B 13/125 |
| 9,834,413 | B2 * | 12/2017 | Mittermayr | B66B 13/12 |
| 2006/0243535 | A1 * | 11/2006 | Kinoshita | B66B 13/12 187/319 |
| 2012/0118676 | A1 * | 5/2012 | Utsunomiya | B66B 13/12 187/330 |
| 2012/0305336 | A1 * | 12/2012 | Walker | B66B 13/12 187/330 |
| 2013/0048433 | A1 * | 2/2013 | Tantis | B66B 13/12 187/319 |
| 2017/0130486 | A1 * | 5/2017 | Zappa | B66B 13/06 |
| 2017/0190547 | A1 * | 7/2017 | Dharmaraj | B66B 13/12 |
| 2018/0265332 | A1 * | 9/2018 | Zhang | B66B 13/12 |

* cited by examiner

ELEVATOR DOOR COUPLER ASSEMBLY

CROSS-REFERENCE TO RELATED APPLICATIONS

The present application is a nonprovisional patent application, which claims priority to U.S. Patent Application Ser. No. 62/274,573, filed Jan. 4, 2016, which is herein incorporated in its entirety.

TECHNICAL FIELD OF THE DISCLOSED EMBODIMENTS

The present disclosure generally relates to door assemblies for elevator systems, and more particularly, an elevator door coupler system.

BACKGROUND OF THE DISCLOSED EMBODIMENTS

Elevator systems are in widespread use for carrying passengers between various levels in buildings, for example. Access to an elevator car requires that elevator car doors, which are attached to the elevator car and move with the elevator car as it travels within the hoist ay, open when the car is at a landing at which a passenger desires to board the elevator car, for example. Each landing includes hoistway doors that do not move with the elevator car, but do move synchronously with the elevator car doors between open and closed positions.

There are various known arrangements for coupling the elevator car doors to the hoistway doors so that the door mover that causes movement of the elevator car doors also causes desired movement of the hoistway doors. Most arrangements include a pair of vanes, each having a vane surface, supported on the elevator car door structure and a set of rollers supported on the hoistway door structure. When the rollers are received adjacent the vanes when the elevator car arrives at the landing, it is possible to move both the elevator car doors and the hoistway doors together. The movement of the elevator car doors causes one of the vanes to push on one of the rollers to move the hoistway door in one direction and the other vane to push on the other roller to move the hoistway door in the other direction.

Typically, when an elevator car is outside the unlocking zone, the hoistway doors or elevator car doors are arranged such that they cannot be opened more than 4 in. (102 mm) from inside the elevator car. The hoistway doors or elevator car doors may be unlocked when the elevator car is within 3 in. (76 mm) above or below the landing and may be permitted to be unlocked up to 7 in. (178 mm) above or below the landing.

Previously, elevator car doors were permitted to be unlocked up to 18 in. (457 mm) above or below the landing. In the prior art configuration shown in FIG. 1, the hoistway interlock roller 2 is shown with respect to the coupler 4 when the opening height is 8 feet. In the present arrangement, a passenger may manually attempt to unlock the car and hoistway doors if the elevator car is within 18.1 inches of the landing in the up direction.

In the prior art configuration shown in FIG. 2, the hoistway interlock roller 2 is shown with respect to the coupler 4 when the opening height is 7 feet. In this arrangement, a passenger may manually attempt to unlock the car and hoistway doors if the elevator car is within 17.5 inches of the landing in the up direction. Each arrangement in the prior art allows for the car and hoistway doors to be opened beyond the required distance. Because the unlocking zone has been reduced, and with different opening heights in the hoistway, the coupler shown in FIGS. 1 and 2 will be less effective. Due to the change in the unlocking zone, systems with different hoistway opening heights may require multiple door couplers, and as such, increase the cost of the elevator system.

Accordingly, there is a need for an elevator door coupler that can accommodate multiple hoistway opening heights.

SUMMARY OF THE DISCLOSED EMBODIMENTS

In one aspect, an elevator assembly is provided. The elevator assembly includes an elevator car door configured to be arranged in a door open and a door closed configuration, a coupling assembly operably coupled to the elevator car door. The coupling assembly includes a first vane, including a first surface extending longitudinally vertically to the elevator car door, a second vane, including a second surface and a third surface extending longitudinally vertically in parallel with the first vane; wherein the second surface is laterally spaced to the first surface by a first coupling length, and the third surface is laterally spaced to the first surface by a second coupling length, an elevator hoistway door positioned parallel to the elevator car door, the elevator hoistway door configured to operate in concert with the elevator car door in a door open and door closed configuration, and an interlock assembly operably coupled to the elevator hoistway door. The interlock assembly includes a first engaging member and a second engaging member laterally spaced from the first engaging member by an engagement length. The first engaging member is configured to engage the first vane and the second engaging member is configured to engage the third surface in the door open configuration.

In any embodiment of the elevator assembly, the engagement length is equal to approximately 4.5 inches.

In any embodiment of the elevator assembly, the second coupling length is equal to approximately 3.75 inches in a door closed configuration. In any embodiment of the elevator assembly, the second coupling length is equal to approximately 4.92 inches in a door open configuration.

In another aspect, a coupling assembly for an elevator door is provided. The coupling assembly includes a first vane, including a first surface extending longitudinally vertically to the elevator car door and a second vane, including a second surface and a third surface extending longitudinally vertically in parallel with the first vane. The second surface is laterally spaced to the first surface by a first vane length, and the third surface is laterally spaced to the first surface by a second vane length.

In any embodiment of the coupling assembly, the second coupling length is equal to approximately 3.75 inches in a door closed configuration. In any embodiment of the coupling assembly the second coupling length is equal to approximately 4.92 inches in a door open configuration.

In one aspect, an interlock assembly for an elevator door is provided. The interlock assembly includes a first engaging member and a second engaging member laterally spaced from the first engaging member by an engagement length, wherein the engagement length is equal to approximately 4.5 inches.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

Figure 1:
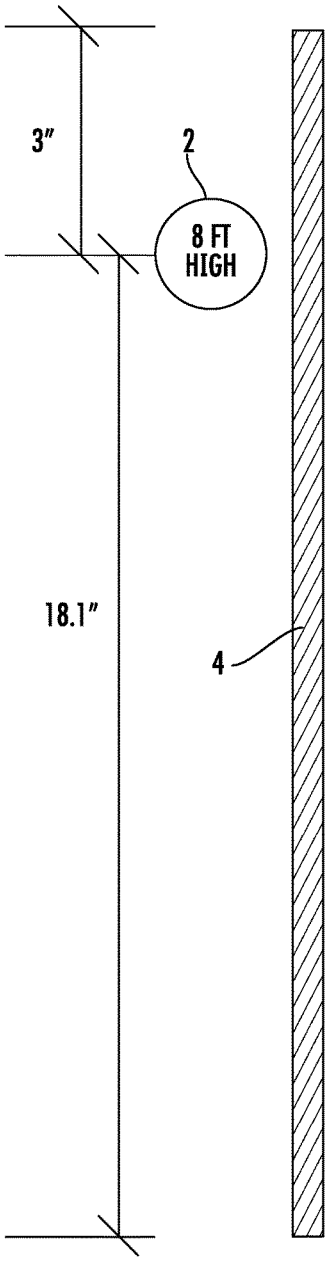
FIG. 1 is a schematic diagram of an interlock and coupler assembly in the prior art.
Figure 2:
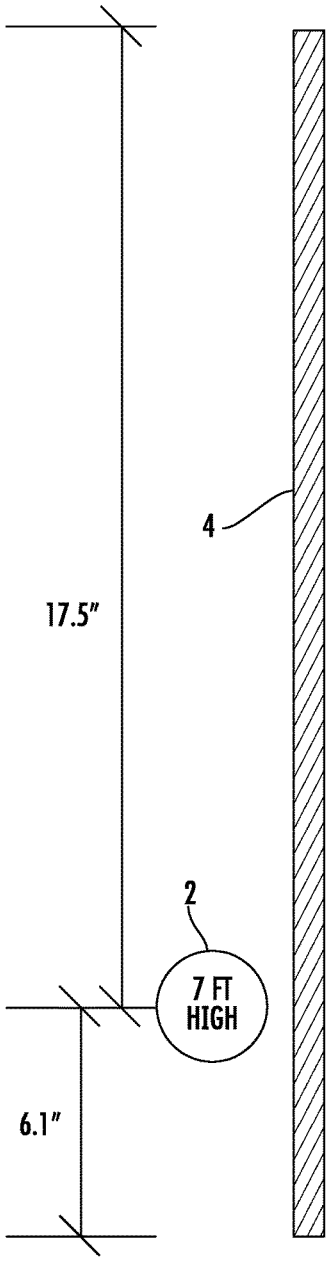
FIG. 2 is a schematic diagram of an interlock and coupler assembly in the prior art.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

Figure 3:
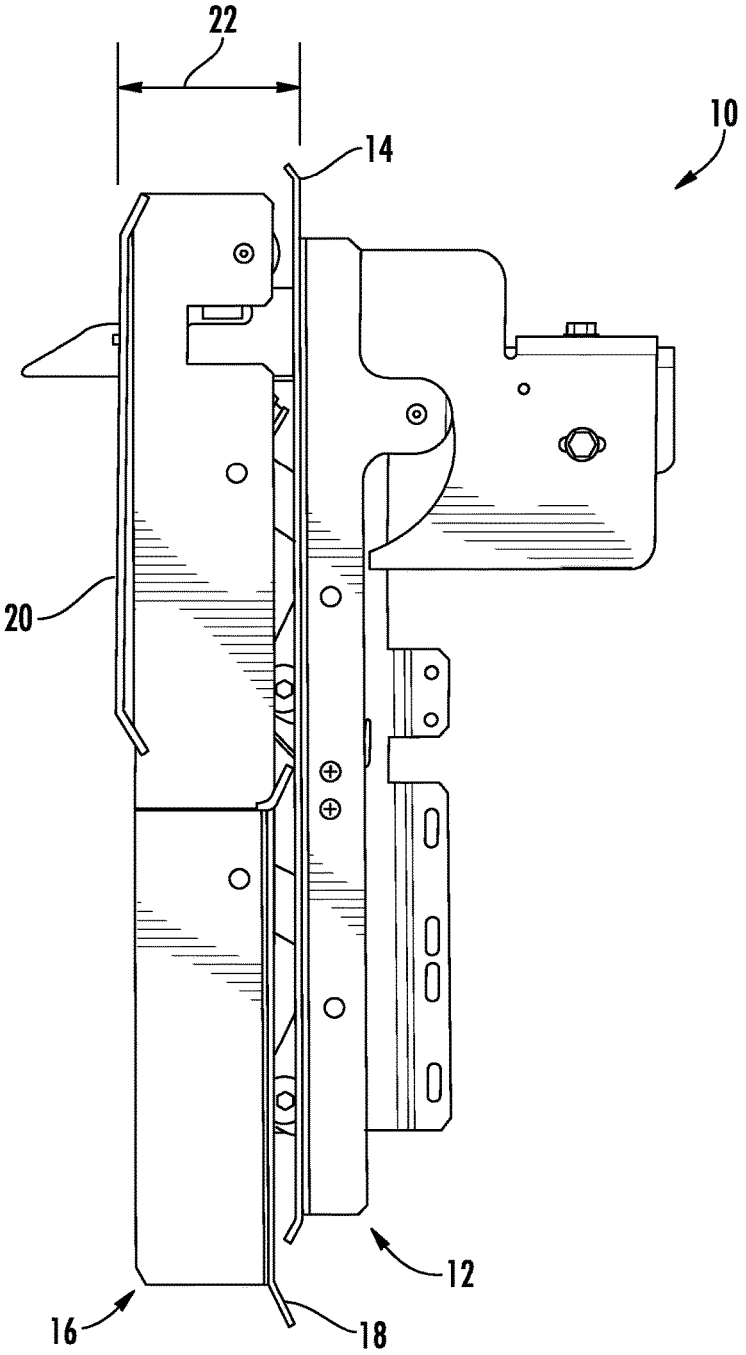
FIG. 3 is a schematic diagram of a coupling assembly according to an embodiment of the present disclosure.

FIG. 3 illustrates an embodiment of the coupling assembly, generally indicated at 10, according to an embodiment of the present disclosure to accommodate varying hoistway openings heights. The coupling assembly 10 shown in a door closed position. The coupling assembly 10 includes a first vane 12, including a first surface 14. The coupling assembly 10 further includes a second vane 16 including a second surface 18 and a third surface 20. The second vane 16 extends longitudinally, vertically in parallel with the first vane 12. The second vane 16 is, in this position, spaced laterally from the first vane 12. The second surface 18 and third surface 20 extend longitudinally vertically in parallel with the first surface 14. The third surface 20, is, in this position, spaced laterally from the first surface 14 by a coupling length 22 equal to approximately 3.75 in. (95 mm.).

Figure 4:
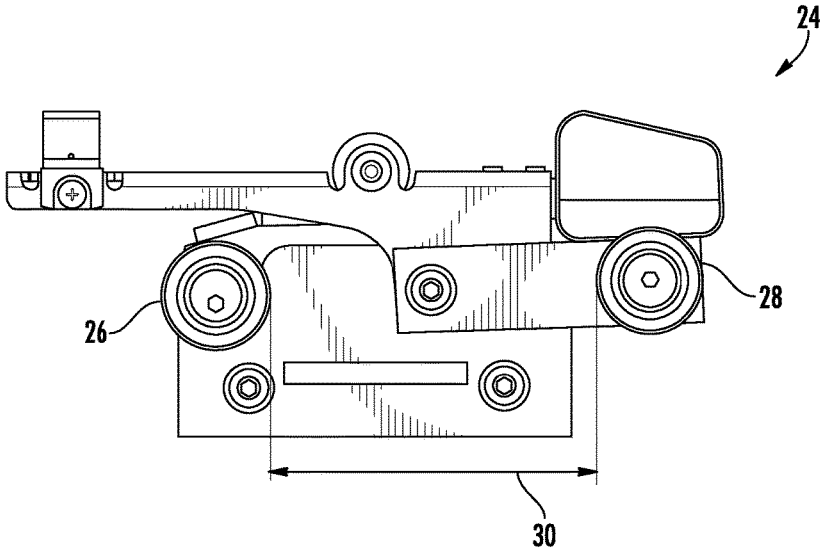
FIG. 4 is a schematic diagram of an interlock assembly that may be used with tall openings height according to an embodiment of the present disclosure.
Figure 5:
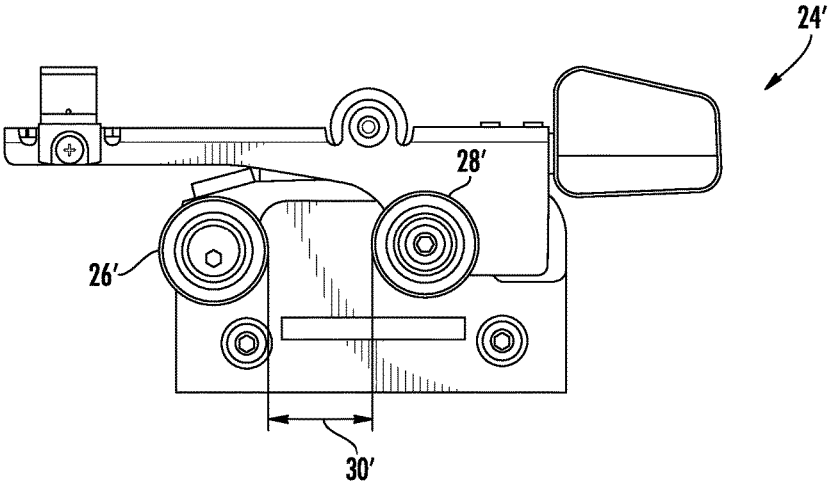
FIG. 5 is a schematic diagram of an interlock assembly that may be used with a typical openings height according to an embodiment of the present disclosure.

FIGS. 4 & 5 illustrate embodiments of an interlock assembly 24 and 24' according to embodiments of the present disclosure. The interlock assembly 24 may be used to accommodate taller hoistway openings, for example 8 foot (approximately 2.4 meters) openings, whereas interlock assembly 24' may be used to accommodate typical hoistway opening heights, for example 7 foot (approximately 2.1 meters) openings.

The interlock assembly 24 (24') includes a first engaging member 26 (26') and a second engaging member 28 (28'). The first engaging member 26 (26') and the second engaging member 28 (28') are laterally spaced apart by an engagement length 30 (30'). The engagement length 30 for interlock assembly 24 is equal to approximately 4.5 inches (approximately 115 millimeters). The engagement length 30' for interlock assembly 24' is equal to approximately 1.5 inches (approximately 38 millimeters). The engaging members 26 (26'), 28 (28') may be any sort of raised boss, bumper, rod, roller, etc. and which provides a simple and effective means for enabling the elevator door coupling assembly 10 to engage and move the hoistway doors 42, 44 (as shown in FIGS. 6-9).

Figure 6:
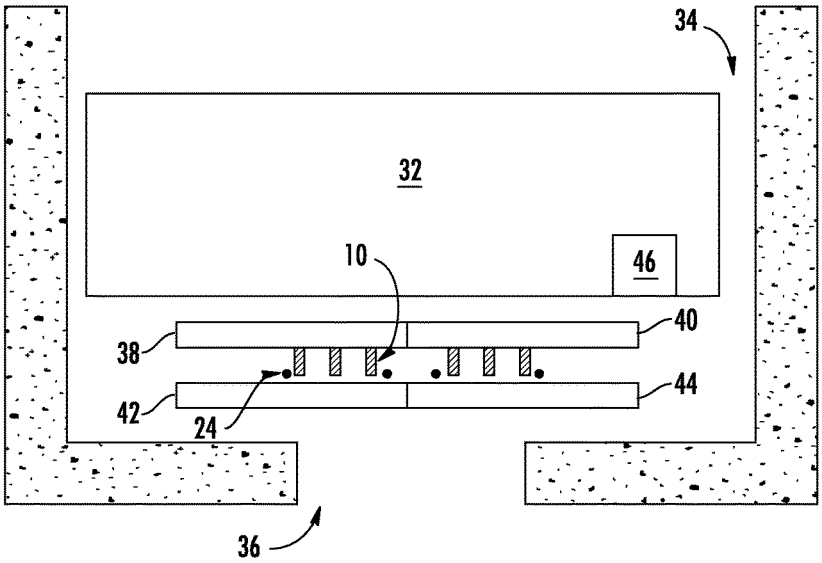
FIG. 6 is a schematic diagram of an elevator car in a hoistway at a taller hoistway opening height in a door closed position according to an embodiment of the present disclosure.

FIG. 6 provides a simplified schematic illustration of an elevator car 32 disposed in a vertical hoistway 34 and positioned so as to correspond to a landing having a taller hoistway opening 36. Elevator car doors 38, 40 are shown in correspondence with laterally sliding hoistway doors 42, 44. As is typical in such installations, the elevator car doors 38, 40 are actuated by a door opener 46 shown here disposed atop the elevator car 32 or at the top of the elevator car doors 38, 40, and having a drive linkage, or the like (not shown).

The coupling assembly 10 is secured to the elevator car door 38, 40 and extends longitudinally vertically with respect thereto. The first surface 14 is positioned proximate to first engaging member 26 of the interlock assembly 24 and the third surface 20 is positioned proximate to second engaging member 28 of the interlock assembly 24 when the hoistway doors 42, 44 are also fully closed. The first vane 12 and the second vane 16 are supported relative to the elevator car doors 38, 40 by pivoting links (not shown) which enable both horizontal and vertical movement of the first vane 12 and the second vane 16 relative to the movement of the elevator car doors 38, 40 and relative to one another, while at all times remaining parallel to one another.

The coupling assembly 10 is disposed on the elevator car doors 38, 40 is shown engaged with a corresponding interlock assembly 24 which extends inward from the hoistway doors 42, 44. As will be appreciated by those skilled in the art, it is desirable that the coupling assembly 10 firmly engage the interlock assembly 24 when the elevator car doors 38, 40 and the hoistway doors 42, 44 are operated, and also desirable that the coupling assembly 10 completely release the interlock assembly 24 and maintain sufficient running clearance as the elevator car 32 moves vertically When disposed in the configuration as shown in FIG. 6, the coupling assembly 10 is well adapted to permit vertical movement of the elevator car 32 within the hoistway 34. The first surface 14 and third surface 20 permit the first engaging member 26 and the second engaging member 28 of the respective landings to be passed easily without danger of interference or contact.

Figure 7:
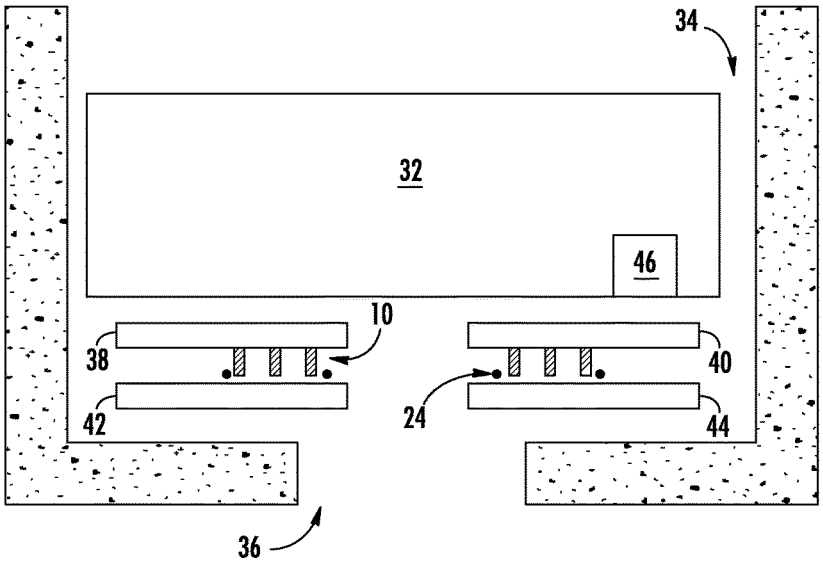
FIG. 7 is a schematic diagram of an elevator car in a hoistway at a taller hoistway opening height in a door partially open position according to an embodiment of the present disclosure.

FIG. 7 shows the arrangement of FIG. 6, wherein the elevator car doors 38, 40 and hoistway doors 42, 44 are shown in a partially opened condition. When the elevator car doors 38, 40 are retracted a small distance from its closed position, the combined action of the pivoting links laterally move the first vane 12 and the second vanes 16 such that the first engaging member 26 contacts the first surface 14 and the second engaging member 28 contacts the third surface 20. As will be appreciated, further motion of the elevator car doors 38, 40 in the opening direction, i.e., to the left for elevator car door 38 and right for elevator car door 40, in this example, will result in the engagement of the first engaging member 26 and the second engaging member 28, and hence the hoistway door 42 being also moved leftward and open, and the hoistway door 44 being also moved rightward and open.

Figure 8:
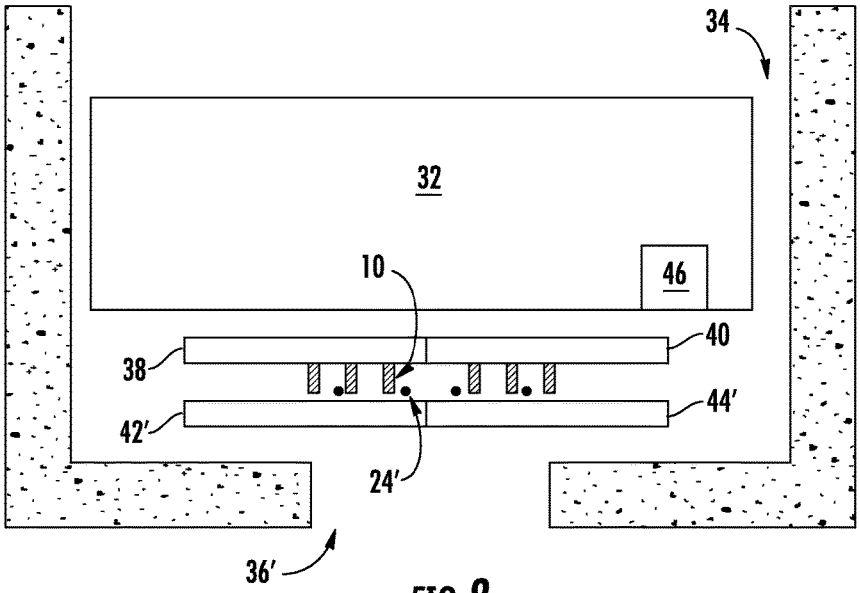
FIG. 8 is a schematic diagram of an elevator car in a hoistway at a typical hoistway opening height in a door closed position according to an embodiment of the present disclosure.

FIG. 8 provides a simplified schematic illustration of an elevator car 32 disposed in a vertical hoistway 34 and positioned so as to correspond to a landing having a typical hoistway opening 36'. Elevator car doors 38, 40 are shown in correspondence with laterally sliding hoistway doors 42', 44'.

The coupling assembly 10 is shown engaged with a corresponding interlock assembly 24' which extends inward from the hoistway doors 42', 44' such that the first surface 14 of the coupling assembly 10 is positioned proximate to first engaging member 26' of the interlock assembly 24' and the second surface 18 of the coupling assembly 10 is positioned proximate to second engaging member 28' of the interlock assembly 24' when the hoistway doors 42', 44' are also fully closed. As will be appreciated by those skilled in the art, it is desirable that the coupling assembly 10 firmly engage the interlock assembly 24' when the elevator car doors 38, 40 and the hoistway doors 42', 44' are operated, and also desirable that the coupling assembly 10 completely release the interlock assembly 24' and maintain sufficient running clearance as the elevator car 32 moves vertically When disposed in the configuration as shown in FIG. 8, the coupling assembly 10 is well adapted to permit vertical movement of the elevator car 32 within the hoistway 34. The first surface 14 and second surface 18 permit the first engaging member 26' and the second engaging member 28' of the respective landings to be passed easily without danger of interference or contact.

Figure 9:
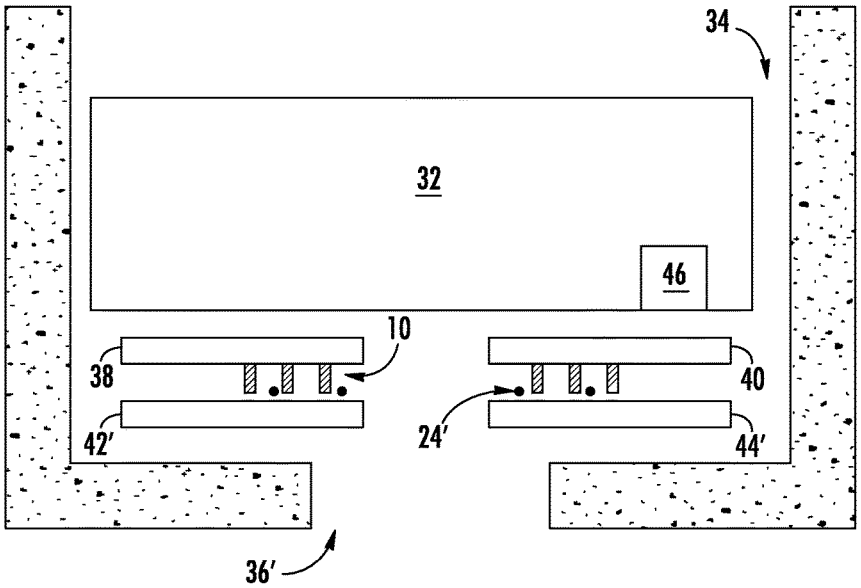
FIG. 9 is a schematic diagram of an elevator car in a hoistway at a typical hoistway opening height in a door partially open position according to an embodiment of the present disclosure.

FIG. 9 shows the arrangement of FIG. 8, wherein the elevator car doors 38, 40 and hoistway doors 42', 44' are shown in a partially opened condition. When the elevator car doors 38, 40 are retracted a small distance from its closed position, the combined action of the pivoting links laterally move the first vane 12 and the second vanes 16 such that the first engaging member 26' contacts the first surface 14' and the second engaging member 28' contacts the second surface 18. As will be appreciated, further motion of the elevator car doors 38, 40 in the opening direction, i.e., to the left for elevator car door 38 and right for elevator car door 40, in this example, will result in the engagement of the first engaging member 26' and the second engaging member 28', and hence the hoistway door 42' being also moved leftward and open, and the hoistway door 44' being also moved rightward and open.

It will therefore be appreciated that the present embodiments include a coupling assembly 10 including a first surface 14, a second surface 18, and a third surface 20 to accommodate taller and typical hoistway openings in a building without the need of additional components.

While the disclosure has been illustrated and described in detail in the drawings and foregoing description, the same is to be considered as illustrative and not restrictive in character, it being understood that only certain embodiments have been shown and described and that all changes and modifications that come within the spirit of the disclosure are desired to be protected.

What is claimed is:

1. An elevator assembly comprising:

an elevator car door configured to be arranged in a door open and a door closed configuration:

a coupling assembly operably coupled to the elevator car door, wherein the coupling assembly comprises:

a first vane, including a first surface extending longitudinally vertically to the elevator car door;

a second vane, including a second surface and a third surface extending longitudinally vertically in parallel with the first vane;

wherein the second surface is laterally spaced to the first surface by a first coupling length, and the third surface is laterally spaced to the first surface by a second coupling length;

wherein the third surface is laterally spaced to the second surface by a fixed distance;

an elevator hoistway door positioned parallel to the elevator car door, the elevator hoistway door configured to operate in concert with the elevator car door; and an interlock assembly operably coupled to the elevator hoistway door, wherein the interlock assembly comprises:

a first engaging member; and a second engaging member laterally spaced from the first engaging member by an engagement length, wherein the first engaging member is configured to engage the first vane and the second engaging member is configured to engage the third surface in the door open configuration.

2. The elevator assembly of claim 1, wherein the engagement length is equal to approximately 4.5 inches.

3. The elevator assembly of claim 1, wherein the second coupling length is equal to approximately 3.75 inches in a door closed configuration.

4. The elevator assembly of claim 1, wherein the second coupling length is equal to approximately 4.92 inches in a door open configuration.

5. The elevator assembly of claim 1, wherein the wherein the second surface and the third surface are laterally spaced to provide passage of the second engaging member therebetween.

6. The elevator assembly of claim 1, wherein at landings with a first hoistway opening height, only the first surface and the second surface engage the interlock assembly; and at landings with a second hoistway opening height, only the first surface and the third surface engage the interlock assembly.

7. A coupling assembly for an elevator door, the coupling assembly comprising:

a first vane, including a first surface extending longitudinally vertically to the elevator car door; and a second vane, including a second surface and a third surface extending longitudinally vertically in parallel with the first vane;

wherein the second surface is laterally spaced to the first surface by a first coupling length, and the third surface is laterally spaced to the first surface by a second coupling length;

wherein the third surface is laterally spaced to the second surface by a fixed distance.

8. The coupling assembly of claim 7, wherein the second coupling length is equal to approximately 3.75 inches in a door closed configuration.

9. The coupling assembly of claim 7, wherein the second coupling length is equal to approximately 4.92 inches in a door open configuration.

* * * * *